US005199591A

United States Patent [19]

Thibeault et al.

[11] Patent Number: 5,199,591

[45] Date of Patent: Apr. 6, 1993

[54] RESEALABLE FLIP-TOP CAN

[75] Inventors: Richard A. Thibeault; Deborah M. Thibeault, both of Nashua, N.H.

[73] Assignee: Preferred Cantop Corporation, Amherst, N.H.

[21] Appl. No.: 795,535

[22] Filed: Nov. 21, 1991

[51] Int. Cl.[5] ..... B65D 51/18

[52] U.S. Cl. ..... 220/253; 220/258; 220/336; 220/703

[58] Field of Search ..... 220/253, 256, 258, 336, 220/703, 711, 713, 714, 717, 718; 215/236

[56] References Cited

U.S. PATENT DOCUMENTS

| | | | |
|---|---|---|---|
| 3,486,665 | 12/1969 | La Croce | 220/306 X |
| 3,889,842 | 6/1975 | Bennett | 220/253 |
| 4,098,439 | 7/1978 | Blow, Jr. et al. | 220/306 X |
| 4,579,257 | 4/1986 | Brandlein | 220/717 X |
| 4,715,510 | 12/1987 | Vander Meulen et al. | 220/718 |
| 4,717,039 | 1/1988 | Ayyoubi | 220/253 |
| 4,790,444 | 12/1988 | Terzi | 220/714 |
| 4,880,136 | 11/1989 | Englert | 220/253 |
| 4,930,654 | 6/1990 | Thibeault et al. | 220/253 |

*Primary Examiner*—Allan N. Shoap
*Assistant Examiner*—Nova Stucker
*Attorney, Agent, or Firm*—Joseph Funk

[57] ABSTRACT

What is disclosed is a resealable flip-top beverage can having a rotatable sealing top mounted above the can top of the beverage can, and the sealing top is rotated into a first position to open a hole in the top of the beverage can and through which the contents of the can are dispensed, and is rotated into a second position where the sealing top reseals the hole. Sealing means are provided on the top of the can top and on the underside of the sealing top that cooperate to prevent beverage from getting between the can top and the sealing top when the can is opened, preventing matter from entering the can when it is resealed, and holding carbonation in said can when it is resealed.

10 Claims, 1 Drawing Sheet

RESEALABLE FLIP-TOP CAN

FIELD OF THE INVENTION

This invention relates to flip-top beverage cans, and more particularly to flip-top cans that are resealable to hold gas pressure after they have been opened.

BACKGROUND OF THE INVENTION

In the prior art there are beverage containers that may be resealed after they have been opened. One type of such containers are glass or plastic bottles that are resealed by separately purchased devices that are placed in or on the openings of the bottles. Another type are the glass or plastic bottles that have screw on caps. The caps may be replaced to reseal the bottle.

There is prior art teaching resealing a flip-top beverage can after it has been opened to protect the contents against contamination by particles in the air and insects, but this prior art does not provide a good, yet inexpensive way to reseal a can that can also maintain carbonation in beverage remaining inside the can.

Thus, there is a need in the art for a flip-top beverage can that can be opened in the manner well known in the art, but which is able to be resealed and hold carbonation.

There is also a need in the art for a flip-top beverage can that has integral resealing means to prevent contamination of the can contents.

SUMMARY OF THE INVENTION

The foregoing needs of the prior art are satisfied by the present invention which is a resealing means mechanism that is an integral part of the beverage can. The top of the novel resealable flip-top can has a separate sealing top that is mounted on top of the conventional flip-top opening top. After the can has been opened in a conventional manner, the sealing top is designed to seal the opening in the top of the can. This makes the novel resealable flip-top beverage can safe against contamination, and it can also hold carbonation in the remaining contents in the can.

The mechanism is an innovative solution to the need for a resealable flip-top can. Using the mechanism with existing flip-top cans enables consumers to reseal the can to preserve the contents, prevent contamination by foreign matter, and minimize loss of carbonation when the beverage is not consumed immediately. Allowing a consumer to reseal a flip-top can allows them to take precautionary measures against contamination of the contents by pollutants in the atmosphere (as in work places such as auto body and woodworking shops, and on construction sites), and also to maintain carbonation in the resealed can. Resealable flip-top cans are very practical on outings, picnics and other outdoor activities in that they remove the fear of foreign objects such as insects falling from trees, flying insects, and crawling insects from getting into the beverage can. It also makes it less convenient for individuals to deposit unwanted items such as cigarette butts into an open, unattended can before the contents have been completely consumed. The above listed instances pose real health risks should the contents thereafter be consumed. In addition, it is nicer to drink a beverage that has not lost its carbonation.

The resealable flip-top can also has a very practical advantage. It minimizes the chances of accidental spills that are very messy to clean up. Such spills readily occur in moving motor vehicles, on boats and in aircraft. The resealable top mechanism provides a leakproof seal that can maintain carbonation in the can when it is closed properly.

BRIEF DESCRIPTION OF THE DRAWING

The present invention will be better understood upon reading the following detailed description in conjunction with the drawing in which.

DETAILED DESCRIPTION

Figure 1:
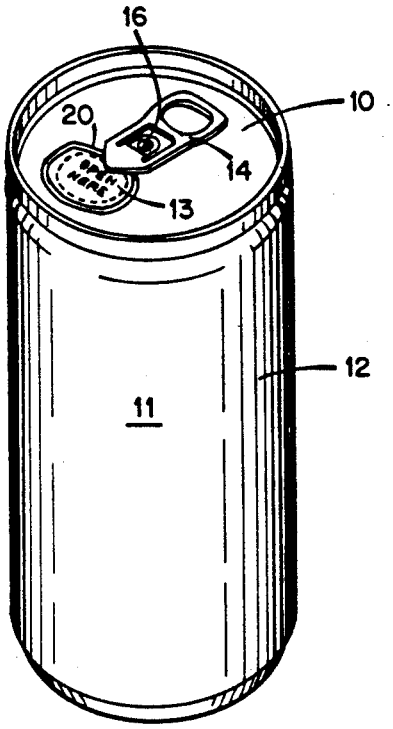
FIG. 1 is a top orthogonal view of the top of a conventional flip-top can with opening tab ring, modified slightly to provide sealing in accordance with the teaching of the invention.

In FIG. 1 is shown a view of a can top 10 of a conventional flip-top beverage can 11. Ridge 20 and the "CLOSED" (not shown but under ring 14) and "OPEN HERE" indicia are added to implement the present invention. As is known, can top 10 is manufactured separately from the container portion 12 of the can and is attached to container portion 12 after a beverage is placed therein. There is a scoring 13 (shown as a dotted line) partially through can top 10. Scoring 13 is pushed down using ring 14 in a manner well known in the art to open a hole 15 (not shown) by breaking scoring 13 so that the contents of can 11 may be dispensed. In the prior art ring 14 is fastened to the middle of conventional can top 10 with a rivet type protrusion 16 that is formed as part of can top 10. When ring 14 is lifted in a manner known in the art, a tip portion thereof is forced down against the portion of can top 10 within scoring 13 to rupture can top 10 within the area enclosed by scoring 13 to create hole 15 and thereby open beverage can 11. The beverage in container portion 12 may then be consumed.

To implement the present resealable top invention some changes are made to the conventional can top 10. First, during manufacture of can top 10 there is a upward extending, curved, raised ridge 20 formed around scored area 13 (hole 15) in FIG. 1. The function of ridge 20 in implementing the invention is described further in this detailed description. Second, rivet type protrusion 16 is made a little longer to captivate not only ring 14, but also another member (a sealing top 17) that is used in implementing the invention. Sealing top 17 is described further in this detailed description. In addition, the indicia "CLOSED" (not shown) stamped under key 14 and "OPEN HERE" within scoring 13 are stamped into the upper surface of can top 10 to aid in determining if the can is unopened, or opened and resealed as is described further in this detailed description. Other indicia may also be stamped into can top 10. In the preferred embodiment of the invention conventional can top 10 and ring 14 are preassembled with a new sealing top 17 before they are attached to container 12 to complete beverage can 11 in the same manner as is presently done in the prior art.

Figure 2:
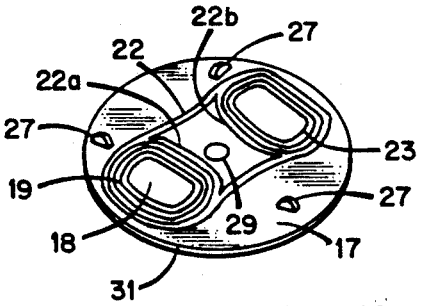
FIG. 2 is a top orthogonal view of a sealing top piece used to reseal the open top of the resealable flip-top can of the present invention, and shows the means for sealing the can to maintain carbonation.

In FIG. 2 is shown a new sealing top 17 that is used in conjunction with modified, conventional can top 10 to implement the present invention and provide a resealable beverage can 11. New sealing top 17 may be formed of the same type of material as can top 10 and container portion 12 are formed of, and may be formed by a single stamping action. However, the raw metal sheet used to form sealing top 17 also has a layer of a rubber type plastic 31 bonded to its bottom surface, and is used to implement the resealing action as will be better understood in reading further in this detailed description. The rubber type plastic material 31 may be of the same type as is used inside screw off bottle caps and used to seal those bottles, or may be of other sealing materials well known in the prior art.

In a preferable one step forming action of sealing top 17 it has an opening 18 stamped therethrough that is of the same shape and size as hole 15 in can top 10 created when beverage can 11 is opened. Formed in sealing top 17 are downwardly extending, curved raised ridges 19, 22 and 23. Ridge 22 extends across sealing top 17 and has cross ridge portions **22*a* and 22*b*. Ridge 19 goes around hole 18 through sealing top 17, and ridge 23 has the same shape as ridge 19 but does not go around a hole. The rubber type plastic material 31 on the bottom of sealing top 17 is, accordingly, over the peaks of the downwardly extending parallel ridges 19, 22 and 23 and cross ridge portions 22*a* and 22*b*. Ridges 19, 22 and 23 and how they cooperate with ridge 20 formed in can top 10 to provide a resealable flip-top can 11** that can maintain carbonation is described further in this detailed description.

In stamping out sealing top 17 there is created a small central hole 29 through top 17. As briefly described previously, sealing top 17 and ring 14 are pre-attached to the upper or outer surface of can top 10 using the slightly longer rivet type protrusion 16. When being attached together with can top 10 and ring 14 by rivet type protrusion 16, sealing top 17 has its surface that is coated with rubber type plastic material 31 facing downward toward can top 10. The assembly of can top 10, sealing top 17 and ring 14 are thereafter fastened to the top of container 12 after it has been filled with a beverage.

Downwardly extending ridges 19, 22, **22*a*, 22*b* and 23 formed in sealing top 17 provide a rigidity to sealing top 17 that aids in the sealing action between sealing top 17 and can top 10. If additional rigidity is desired, depending on the material that sealing top 17 is made of, additional ridges (not shown) may be formed in top 17**.

In a alternative embodiment of the invention ridges **22*b* and 23 may be located ninety degrees from opening 18 so that dealing top 17** need only be rotated one-quarter turn between its open position and the resealed position. One skilled in the art will recognize that the ridges may located at other angles also.

Sealing top 17 also has three upwardly extending, stamped protrusions 27 located at a radial distance R from hole 19. Protrusions 27 are rounded in a radial orientation with top 17, and metal of top 17 is torn on two opposed sides of protrusions 27 to create essentially vertical sides in a circular orientation. Protrusions 27 are used to rotate sealing top 17 to reopen and reseal can 11 as described further in this detailed description.

In the preferred embodiment of the invention the complete top comprising can top 10, rivet 16 and sealing top 17 are assembled separately from container portion 12. As is known in the art, a container portion 12 is filled with a beverage and then an assembled can top is attached thereto by rolling their edges together.

Sealing top 17 has a smaller diameter than can top 10 that comes up to the inside of the rolled edge rim of completely assembled beverage can 11. Top 17 can be rotated under rivet 16 so that its opening 18 can be in registration with hole 15 through can top 10 after it is opened to dispense a beverage in can 11, or it may be rotated one-hundred eighty degrees so that beverage container 11 may be resealed per the teaching of the present invention.

To provide pressure resealing of carbonation of beverage in can 11 per the teaching of the present invention, and to also prevent contamination of the beverage inside can 11 there is a seal provided between can top 10 and sealing top 17. As previously described with reference to FIG. 1, there is an upwardly extending, raised ridge 20 that passes around hole 15 created when scored area 13 is broken. As previously described with reference to FIG. 2, novel sealing top 17 has parallel downwardly extending, parallel ridges 19, 23 and 22 with cross ridges **22*a* and 22*b* stamped therein. The spacing between ridges 19 and 22 with 22*a*, and between ridges 23 and 22 with 22*b* is the same as the width of upwardly extending raised ridge 20 on can top 10**.

When hole 18 through sealing top 17 is in registration with hole 15 in can top 10 (after scored area 13 is broken), to dispense beverage from opened can 11, upwardly extending raised ridge 20 that pass around hole 15 lies between downwardly extending, raised ridges 19, 22 and **22*a* on sealing top 17. Thus, there is a seal completely around hole 15. This prevents any beverage from getting in between cantop 10 and sealing top 17 when the beverage is being dispensed from opened can 12**.

When sealing top 17 is rotated one-hundred eighty degrees to reseal can 12, there is again a meshing of the ridges, but upwardly extending ridge portion 20 then lies between downwardly extending ridge portions 23, 22 and **22*b*. Since there is no opening through sealing top 17 in the area within ridge 23 hole 15 (created by breaking scored area 13 in top 10) is completely covered and sealed. Thus, there is an effective seal preventing contamination of the beverage, maintaining carbonation in the remaining beverage, and preventing beverage from getting between sealing top 17 and can top 10 when can 11** is resealed).

In either the open position or the closed position of sealing top 17 there are created vertical forces against top 17. To prevent the edges of sealing top 17 from bowing upward from the vertical forces the stiffening action of ridges 19, 22, **22*a*, 22*b* and 23 is utilized. It is sufficient to provide a very effective sealing pressure between can top 10 and sealing top 17**.

Due to the rounded cross section of all the ridges, when sealing top 17 is rotated between its open position and its closed position, ridges 20, 22, **22*a*, 22*b* and 23** cam upward over each other.

To give a positive indication that a flip-top can 11 equipped with the novel resealing top 17 of the present invention has never been opened, or has been opened but is resealed, indicia are stamped into the metal of can top 10 during its manufacture. On the metal within scoring 13 (where hole 15 is created using ring 14) is stamped "OPEN HERE"; while in the metal on the opposite side of can top 10 (under key 14) is stamped "CLOSED". The same indicia in another language may be stamped alongside the English indicia for distribution in areas that have a high non-English speaking population. Alternatively, graphic symbols conveying the same information may be stamped in can top 10. Without such indicia, when beverage can 11 has been unopened it is not known whether hole 18 through rotatable sealing top 18 is in registration with as yet unopened hole 15, or is rotated one-hundred eighty degrees and hole 18 is over the opposite side of can top 10. Other indicia may also be stamped into the upper surface of can top 10 that indicate if rotatable sealing top 17 is in an intermediate position between its fully open or fully closed positions. All these indicia cooperate to properly use resealing top 17 and to prevent attempting to open can 11 when sealing top 17 is in the wrong position which may result in breaking can opening ring 14.

Figure 3:
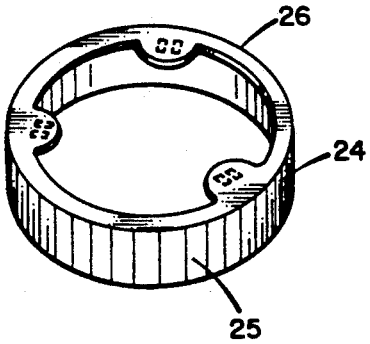
FIG. 3 shows an actuating piece used to rotate the sealing top piece.

While sealing top 17 may be used alone, a plastic actuating means 26 shown in FIG. 3 is provided. Actuating means 26 is preferably manufactured of plastic. It may be seen that actuating means 26 has its middle area selectively removed so that can top 10 and sealing top 17 may be seen and the contents of can 11 may be dispensed. Actuating means 26 has downwardly extending, turned under edges that are shown in detail in FIG. 4, and is of a diameter that actuating means 26 is permanently snapped onto the top of beverage can 11 with can top 10 attached thereto by elastic action as the last step of manufacture. The thickness of, and the type of plastic from which actuating means 26 is fabricated provides an elastic action strong enough that it is not easily removed from can 11. The inside and outside diameter dimensions of actuating means 26 are such that it can be grasped and easily rotated in its installed position on can 11. The sides 24 of actuating means 26 are long enough, and are knurled 25, so that actuating means 26 is easily grasped and turned to open and close can 11. Those skilled in the art will recognize that other separate actuating means may be utilized, and even actuating means that are an integral part of the sealing top.

In addition, the underside of actuating means 26 contacts the top outer edge of sealing top 17 to provide additional resistance to upward forces that lessen the sealing action between can top 10 and sealing top 17 that has been described in the previous paragraphs.

Figure 4:
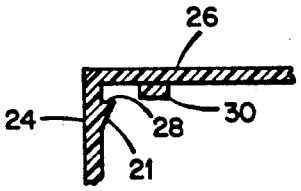
FIG. 4 is a side cutaway view of a part of the actuating piece showing detail of how it is retained on the top of the can.

On the underside of plastic actuating means 26, on the portions 33 that are not removed from the central portion, are formed a few pairs of downwardly extending plastic protrusions 30 that have substantially vertical sides. One of these protrusions 30 is shown in FIG. 4. Plastic protrusions 30 are all located a radial distance R from the geometric center of actuating means 26. This radial distance is the same as for the metal protrusions 27 stamped in sealing top 17. Plastic protrusions 30 are angularly spaced around means 26 at the same angular orientation as metal protrusions 27 formed on sealing top 17. Each of the pairs of downwardly extending plastic protrusions 30 are spaced apart a distance slightly greater than the width of an upwardly extending, stamped protrusion 28.

When plastic actuating means 26 is permanently snapped onto the top of beverage can 11 each of the pairs of plastic protrusions 28 of the underside of actuating means 26 straddle one of the upwardly extending metal protrusions 28 on sealing top 17. As actuating means 26 is manually rotated either clockwise or counter-clockwise using knurled edge 24, the plastic protrusions 28 engage the upwardly extending metal protrusions 28 and cause sealing top 17 to also be rotated. In this manner beverage can 11 is resealed and reopened using plastic actuating means 26.

In FIG. 4 is shown a side cutaway view of plastic actuating means 26. It may be seen that the edge of means 26 has a beveled section 21 that enables means 26 to be snapped onto can 11 at the last step of manufacture, but the flat section 28 that then lies under the rolled edge of can 11 prevents actuating means 26 from easily being removed. In FIG. 4 is also shown one of the downwardly extending plastic protrusions 30.

Figure 5:
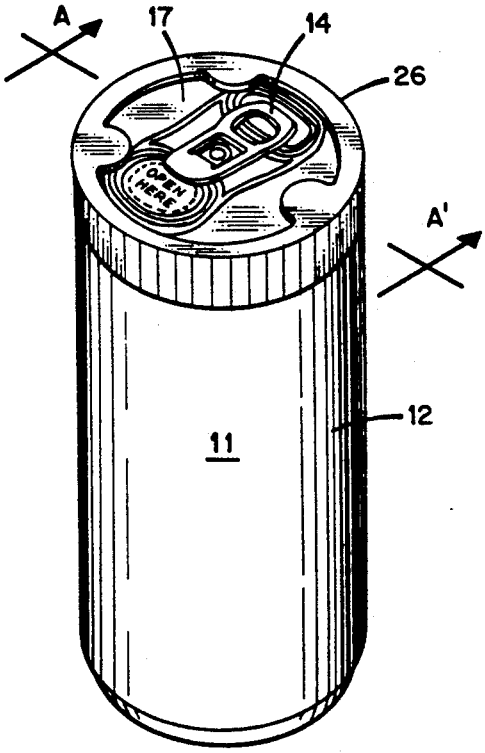
FIG. 5 shows a beverage can including a sealing top piece and actuating means.

In FIG. 5 is shown a fully assembled, resealable flip-top can in accordance with the teaching of the present invention. Actuating means 26 is shown in the position where hole 18 through sealing top 17 is in registration with as yet unopened hole 15 through can top 10. In this position the "OPEN HERE" indicia on can top 10 is seen.

Figure 6:
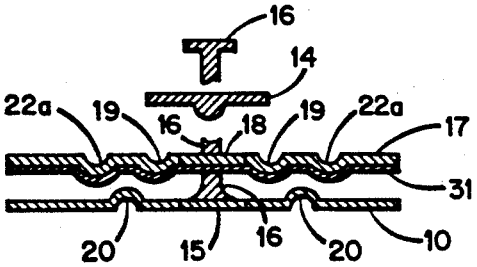
FIG. 6 is an exploded side view of an assembled can top and sealing top showing how a seal is formed around the hole through which beverage is dispensed.

In FIG. 6 is shown an exploded side view of an assembled can top 10 and sealing top 17. The view that is shown is represented in FIG. 5 as arrows A and A'. This cuts through opening 15 in can top 10 and opening 18 through sealing top 17 to help see how a seal is formed around these holes. In FIG. 6 there is can top 10 with a portion of rivet 16 that is extruded from the can top as is well known in the art. Opening 15 is also shown (after scored area 13 is opened). Ridge 20 that goes around opening 15 is also shown.

Above can top 10 is shown sealing top 17 with its sealing layer 31 on its underside and its opening 18. A portion of rivet 16 is also shown as it passes through hole 29 in the middle of sealing top 17. Concentric ridges 19 and 22*a* around opening 18 are also shown. Above sealing top 17 is shown pull tab 14 and the rest of rivet 16 is shown above it.

Opening 18 in sealing top 17 is shown in registration with opening 15 in can top 10 to dispense beverage from can 12. Thus, can 11 is shown in its open position. Opening 18 is represented by two short vertical lines on sealing top 17. When can 11 is in its closed or sealed position after being opened the ridges in the figure would basically be the same except that the vertical lines representing opening 18 would not be present, and the ridges would be designated 22*b* and 23. In FIG. 6 it may be seen that when can top 10 and sealing top 17 are assembled together ridge 20 on can top 10 will lie between ridges 19 and 22*a* on the underside of sealing top 17. Sealing layer 31 on the underside of sealing top 17 will press down on and cover most or all of ridge 20 on can top 10. Due to the rounded shape of ridges 20, 19 and 22*a* they will slide up over each other as sealing top 17 is rotated between the open position and the resealed position.

While what has been described hereinabove is the preferred embodiment of the invention it should be understood that those skilled in the art may make numerous changes without departing from the spirit and scope of the invention. For example, rather than using a uniform thickness layer of rubber type plastic in conjunction with formed ridges on the sealing top, on ridges need be formed and, instead, a rubber type plastic piece having ridges formed therein may be bonded to the underside of the sealing lid. Also, the number, configuration, or shape of sealing ridges may be varied. Also, other actuating means that are integral to or separate from the sealing top may be utilized by those skilled in the art.

What we claim is:

1. A resealable flip-top can for containing a beverage that is opened by a pull tab, said resealable beverage can comprising:

a can top having a first area that is ruptured by said pull tab to open a first opening in said can top through which said beverage is dispensed, said pull tab being fastened to said can top by a rivet in the middle of said can top, and said can top having a first raised ridge thereon forming a closed loop that passes completely around said first opening; and a circular sealing top that is rotatably attached to said can top by said rivet, said sealing top covering substantially all of said can top, said sealing top having a second opening, and said sealing top being rotated into a first position where said second opening is in registration with said first opening in said can top in order to dispense the beverage in said can, said sealing top being rotated into a second position where said second opening is out of registration with said first opening in order to reseal said can, said sealing top having a second ridge forming a closed loop that passes completely around said second opening, and a third ridge forming a closed loop, said second ridge circumferentially contacting said first ridge when said sealing top is in said first position to prevent beverage from getting between said can top and said sealing top when beverage is being dispensed from said can, said third ridge circumferentially contacting said first ridge when said sealing top is in said second position to reseal said can.

2. The invention in accordance with claim 1 further comprising at least one reinforcing ridge formed on said sealing top to reinforce said sealing top against bowing so that said third ridge is held tightly against said first ridge to hold carbonation in said can as well as sealing said can against contaminating material entering said can.

3. The invention in accordance with claim 2 further comprising:

a fourth ridge on said sealing top forming a closed loop that is concentric with said second ridge; and a fifth ridge on said sealing top forming a closed loop that is concentric with said third ridge, wherein said first ridge lies between and circumferentially contacts both said second ridge and said fourth ridge when said sealing top is in said first position, and said first ridge is between and circumferentially contacts both said third ridge and said fifth ridge when said sealing top is in said second position.

4. The invention in accordance with claim 3 wherein said second, third, fourth, and fifth ridges have a sealing means thereon that aids in sealing between these ridges and said first ridge.

5. The invention in accordance with claim 4 wherein said sealing means is a flexible layer on the underside of said sealing top.

6. A resealable flip-top can having a can top with a scored area that is ruptured by a pull tab attached to the can top to form a first opening through which the contents of said can are dispensed, said pull tab being attached to said can top by a rivet, said resealable beverage can comprising:

a first raised ridge on said can top forming a closed loop that passes completely around said first opening formed by rupturing said scored area; and a circular sealing top that is rotatably attached to said can top by said rivet, said sealing top covering substantially all of said can top, said sealing top having a second opening, and said sealing top being rotated into a first position where said second opening is in registration with said first opening in said can top in order to dispense the contents of said can, said sealing top being rotated into a second position where said second opening is out of registration with said first opening in order to reseal said can, said sealing top having a second ridge forming a closed loop that passes completely around said second opening, and a third ridge forming a closed loop, said second ridge circumferentially contacting said first ridge when said sealing top is in said first position to prevent the contents of said can from getting between said can top and said sealing top when said contents are being dispensed from said can, said third ridge circumferentially contacting said first ridge when said sealing top is in said second position to reseal said can.

7. The invention in accordance with claim 6 further comprising at least one reinforcing ridge formed on said sealing top to reinforce said sealing top against bowing so that said third ridge is held tightly against said first ridge to seal said can against contaminating material entering said can.

8. The invention in accordance with claim 7 further comprising:

a fourth ridge on said sealing top forming a closed loop that is concentric with said second ridge; and a fifth ridge on said sealing top forming a closed loop that is concentric with said third ridge, wherein said first ridge lies between and circumferentially contacts both said second ridge and said fourth ridge when said sealing top is in said first position, and said first ridge is between and circumferentially contacts both said third ridge and said fifth ridge when said sealing top is in said second position.

9. The invention in accordance with claim 8 wherein said second, third, fourth, and fifth ridges have a sealing means thereon that aids in sealing between these ridges and said first ridge.

10. The invention in accordance with claim 9 wherein said sealing means is a flexible layer on the underside of said sealing top.

* * * * *